US008973522B2

(12) United States Patent
Larson

(10) Patent No.: US 8,973,522 B2
(45) Date of Patent: Mar. 10, 2015

(54) DUAL FEEDING SPRAY DEVICE AND USE THEREOF

(75) Inventor: John Charles Larson, West Chester, PA (US)

(73) Assignee: Axalta Coating Systems IP Co., LLC, Wilmington, DE (US)

( * ) Notice: Subject to any disclaimer, the term of this patent is extended or adjusted under 35 U.S.C. 154(b) by 139 days.

(21) Appl. No.: 13/419,790

(22) Filed: Mar. 14, 2012

(65) Prior Publication Data

US 2013/0071570 A1 Mar. 21, 2013

Related U.S. Application Data

(60) Provisional application No. 61/452,370, filed on Mar. 14, 2011.

(51) Int. Cl.

| | |
|---|---|
| ***B05C 5/00*** | (2006.01) |
| ***A62C 5/00*** | (2006.01) |
| ***B05D 1/02*** | (2006.01) |
| ***B05D 5/00*** | (2006.01) |
| ***B05B 7/04*** | (2006.01) |
| ***B05B 7/12*** | (2006.01) |
| ***B05B 7/24*** | (2006.01) |
| *B05B 1/30* | (2006.01) |
| *B05B 7/06* | (2006.01) |
| *B05B 7/08* | (2006.01) |

(52) U.S. Cl.

CPC ..... *B05B 7/0408* (2013.01); *B05B 7/1209* (2013.01); *B05B 7/2472* (2013.01); *B05B 7/2424* (2013.01); *B05B 1/3066* (2013.01); *B05B 7/066* (2013.01); *B05B 7/067* (2013.01); *B05B 7/0815* (2013.01); *B05B 7/2478* (2013.01)

USPC ..... 118/300; 239/311; 239/422; 239/424; 427/421.1; 427/426

(58) Field of Classification Search

CPC ..... B05B 1/3046

USPC ..... 118/300; 239/310, 311, 344, 337, 290, 239/291, 398, 406, 433, 421, 424, 302, 379, 239/8, 10; 427/421.1, 426

See application file for complete search history.

(56) References Cited

U.S. PATENT DOCUMENTS

| | | | | |
|---|---|---|---|---|
| 2,757,048 | A | 7/1956 | Balmer | |
| 2,864,653 | A | 12/1958 | Liedberg et al. | |
| 3,049,439 | A * | 8/1962 | Coffman | 427/137 |
| 3,066,874 | A | 12/1962 | Becker | |
| 3,563,459 | A * | 2/1971 | Kautz | 239/8 |
| 3,799,403 | A | 3/1974 | Porbst et al. | |
| 4,462,543 | A * | 7/1984 | Yam | 239/8 |
| 4,824,017 | A | 4/1989 | Mansfield | |

(Continued)

FOREIGN PATENT DOCUMENTS

| | | |
|---|---|---|
| DE | 102008010562 A1 | 9/2009 |
| EP | 0063707 | 11/1982 |

(Continued)

*Primary Examiner* — Yewebdar Tadesse

(74) *Attorney, Agent, or Firm* — Ingrassia Fisher & Lorenz, P.C.

(57) ABSTRACT

This invention is directed to a spray device for spraying two or more components. The two or more components are maintained separated in the spray device and are mixed post atomization. This invention is also directed to a gravity fed spray gun and a dual feeding device for spraying two or more components.

9 Claims, 14 Drawing Sheets

(56) References Cited

U.S. PATENT DOCUMENTS

| | | | | |
|---|---|---|---|---|
| 4,927,079 | A | | 5/1990 | Smith |
| 4,955,544 | A | | 9/1990 | Kopp |
| 5,052,623 | A | | 10/1991 | Nordeen |
| 5,190,219 | A | * | 3/1993 | Copp, Jr. ..... 239/296 |
| 5,639,027 | A | | 6/1997 | Fritz et al. |
| 5,669,557 | A | | 9/1997 | Barrett et al. |
| 5,713,519 | A | | 2/1998 | Sandison et al. |
| 5,799,876 | A | | 9/1998 | Isler |
| 6,264,113 | B1 | | 7/2001 | Dingler |
| 7,201,289 | B2 | | 4/2007 | Bhatia |
| 7,311,265 | B2 | | 12/2007 | Bhatia |
| 8,210,452 | B2 | | 7/2012 | Larson et al. |
| 2010/0270401 | A1 | | 10/2010 | Charpie et al. |

FOREIGN PATENT DOCUMENTS

| | | | |
|---|---|---|---|
| EP | 63707 | A1 | 11/1982 |
| GB | 842959 | | 8/1960 |
| WO | 9513878 | A1 | 5/1995 |
| WO | 03097246 | A1 | 11/2003 |
| WO | 2005092934 | A1 | 10/2005 |
| WO | 2009086335 | A1 | 7/2009 |
| WO | 2010151666 | A1 | 12/2010 |
| WO | 2010151762 | A1 | 12/2010 |
| WO | 2011100003 | A1 | 8/2011 |
| WO | 2011100004 | A1 | 8/2011 |

* cited by examiner

DUAL FEEDING SPRAY DEVICE AND USE THEREOF

FIELD OF INVENTION

The present invention is directed to a spray device for spraying two or more components. This invention is specifically directed to a spray device for spraying a coating composition having two or more components.

BACKGROUND OF INVENTION

Coatings on automotives or other objects typically comprise polymer networks formed by multiple reactive components of a coating composition. The coatings are typically applied over a substrate such as automobile vehicle body or body parts using a spray device or other coating application techniques and then cured to form a coating layer having such polymer networks.

Currently, the multiple reactive components of the coating composition are typically mixed together to form a pot mix prior to spraying and placed in a cup-like reservoir or container that is attached to a spraying device such as a spray gun. Due to the reactive nature of the multiple reactive components, the pot mix will start to react as soon as they are mixed together causing continued increase in viscosity of the pot mix. Once the viscosity reaches a certain point, the pot mix becomes practically un-sprayable. The possibility that the spray gun itself may become clogged with crosslinked polymer materials is also disadvantageous. The time it takes for the viscosity to increase to such point where spraying becomes ineffective, generally a two-fold increase in viscosity, is referred to as "pot life".

One way to extend "pot life" is to add a greater amount of thinning solvent, also known as thinning agent, to the pot mix. However, thinning agent, such as organic solvent, can contribute to increased emissions of volatile organic compounds (VOC) and can also increase curing time.

Other attempts to extend "pot life" of a pot mix of a coating composition have focused on "chemical-based" solutions. For example, it has been suggested to include modifications of one or more of the reactive components or certain additives that would retard polymerization reaction of the multiple components in the pot mix. The modifications or additives must be such that the rate of curing is not adversely affected after the coating is applied to the surface of a substrate.

Another approach is to mix one or more key components, such as a catalyst, together with other components of the coating composition immediately prior to spraying. One example is described in U.S. Pat. No. 7,201,289 in that a catalyst solution is stored in a separate dispenser and being dispensed and mixed with a liquid coating formulation before the coating formulation is atomized.

Yet another approach is to separately atomize two components, such as a catalyst and a resin, of a coating composition, and mix the two atomized components after spray. One such example is described in U.S. Pat. No. 4,824,017. However, such approach requires atomization of two components separately by using separate pumps and injection means for each of the two components.

STATEMENT OF INVENTION

This invention is directed to a spray gun for spraying a coating composition having a first component and a second component, said spray gun comprising:

(A) a spray gun body (1) comprising a carrier inlet (12), a first inlet (10) connected to a first delivery path (9) within said spray gun body connected to a spray nozzle (13), a second inlet (8) connectable to a second delivery path, a spray trigger (22), and a spray nozzle assembly (2) comprising said spray nozzle and an air cap (24), wherein said spray trigger has a stop position, a pre-spray position and a spray position;

(B) a dual feeding cup assembly comprising a first cup (3), a second cup (15), and a cup connection coupling (10*a*) affixing said first cup and said second cup together side-by-side, wherein said cup connection coupling is connectable to said spray gun body;

wherein:

said first component and said second component are maintained separated in said spray gun and said dual feeding cup assembly;

said first inlet is configured to receive said first component by gravity and connected to said first delivery path to convey said first component to said spray nozzle assembly when said spray trigger is at said spray position; and said second inlet is configured to receive said second component by gravity and to convey said second component to said spray nozzle assembly when said spray trigger is at said spray position.

This invention is also directed to a kit for converting a spray gun to spray a coating composition having a first component and a second component, said kit comprising:

(a) a dual feeding cup assembly comprising a first cup (3), a second cup (15), and a cup connection coupling (10*a*) affixing said first cup and said second cup together side-by-side, wherein said cup connection coupling is connectable to said spray gun body; and a delivery device selected from:

(b) a hollow spray needle (11) having a longitudinal channel (11*a*) therein, a channel opening (13*a*) at one end of said hollow spray needle, and a needle inlet (30) at the other end of said hollow spray needle distal to said channel opening (13*a*), and a detachable coupling assembly (18) connectable to said second cup, said hollow spray needle and said spray gun;

(c) an air cap delivery device comprising a delivery outlet (62) connected to a second inlet (8) through a second delivery path, said delivery outlet being positioned within an air cap, said air cap is connectable to said spray gun, and said second inlet is connectable to said second cup; or (d) a combination of (b) and (c).

This invention is also directed to a two-component spray gun comprising the aforementioned kit.

This invention is also directed to a method using the spray gun of this invention for producing a layer of a coating composition comprising a first component and a second component on a substrate.

DETAILED DESCRIPTION

Figure 1:
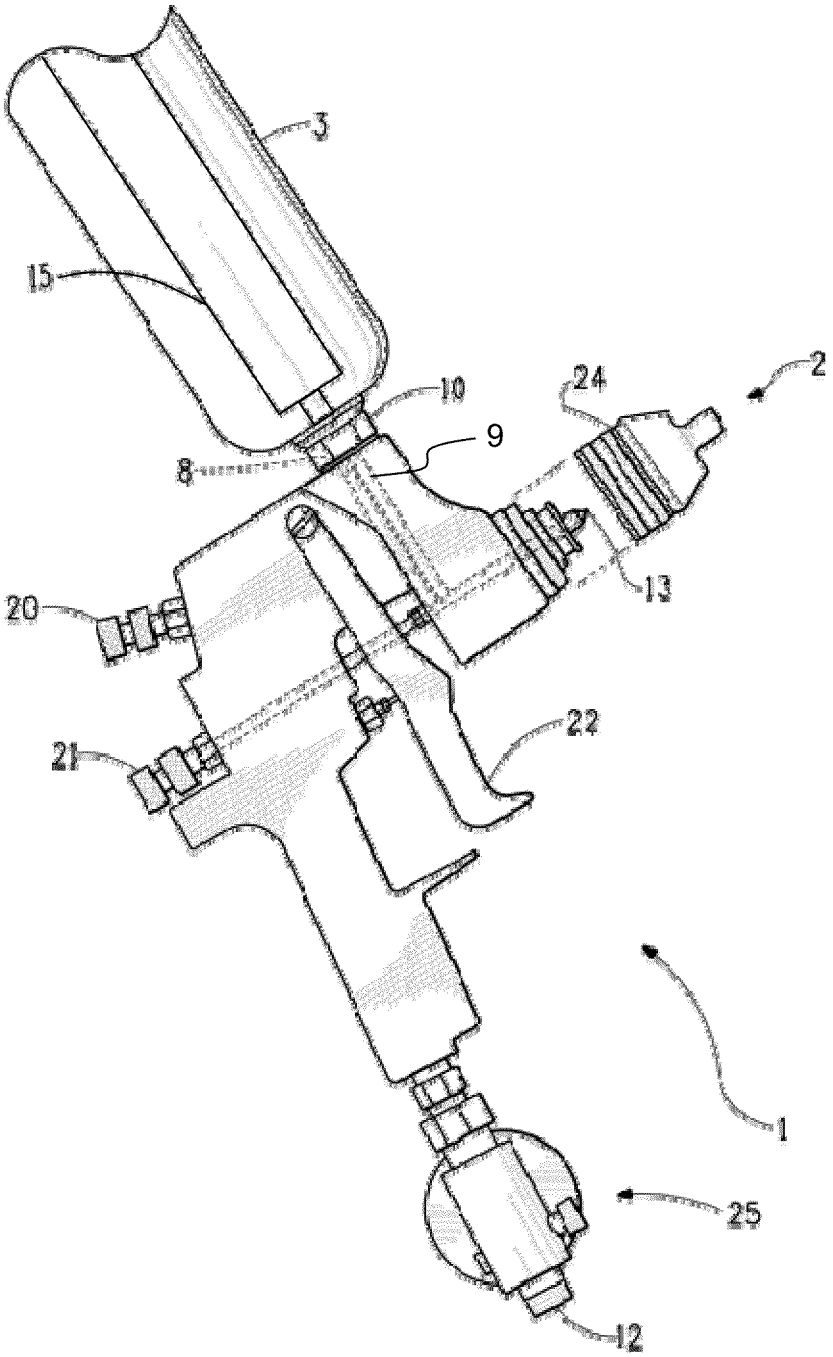
FIG. 1 shows a schematic presentation of an example of a spray gun of this invention.
Figure 2:
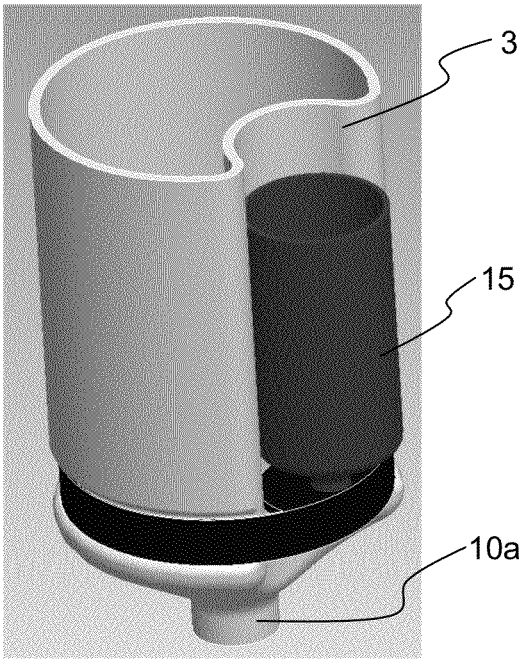
FIG. 2 shows a schematic presentation of an example of a dual feeding cup assembly.
Figure 3A:
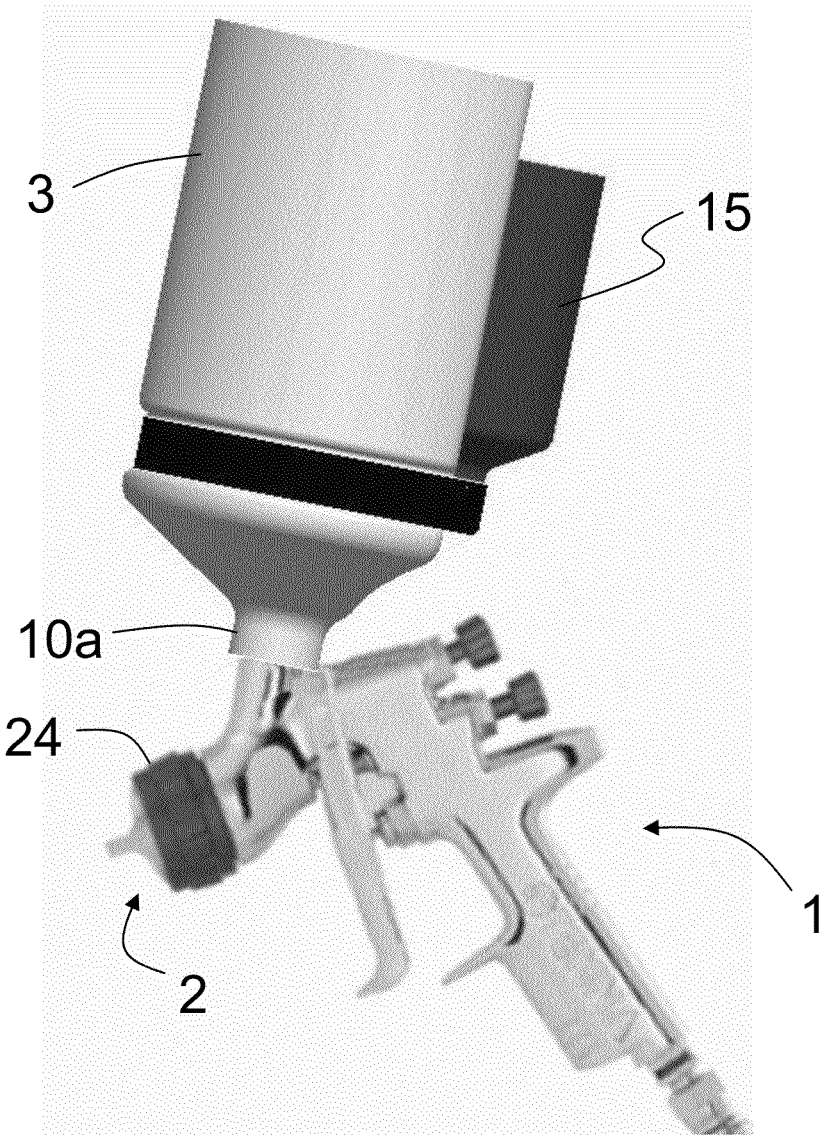
FIG. 3 shows configurations of schematic presentations of examples of a spray gun of this invention. (A) Both the first cup and the second cup are connected to the spray gun through the cup connection coupling. (B) The second cup is connected via a separate connector into the spray gun body. (C) The second cup is connected via a separate connector into a detachable coupling assembly. (D) The second cup is connected via a separate connector into an air cap delivery device.
Figure 3B:
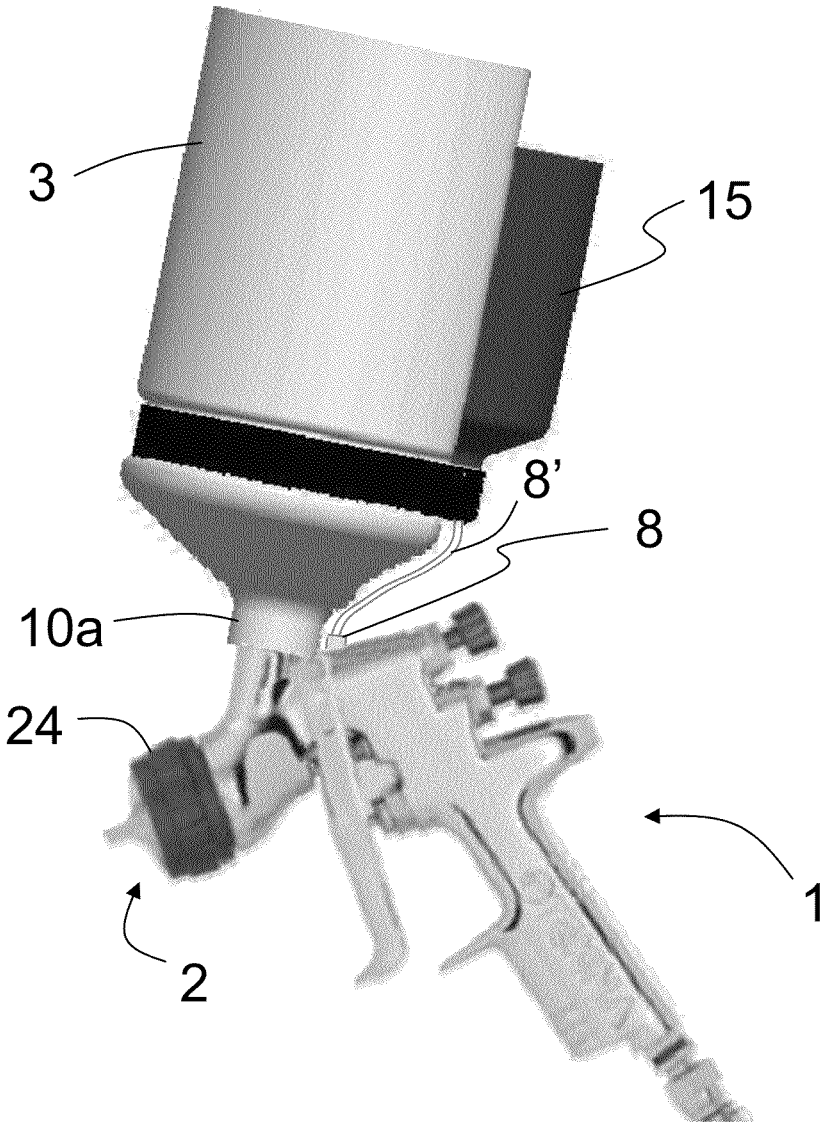
Figure 3C:
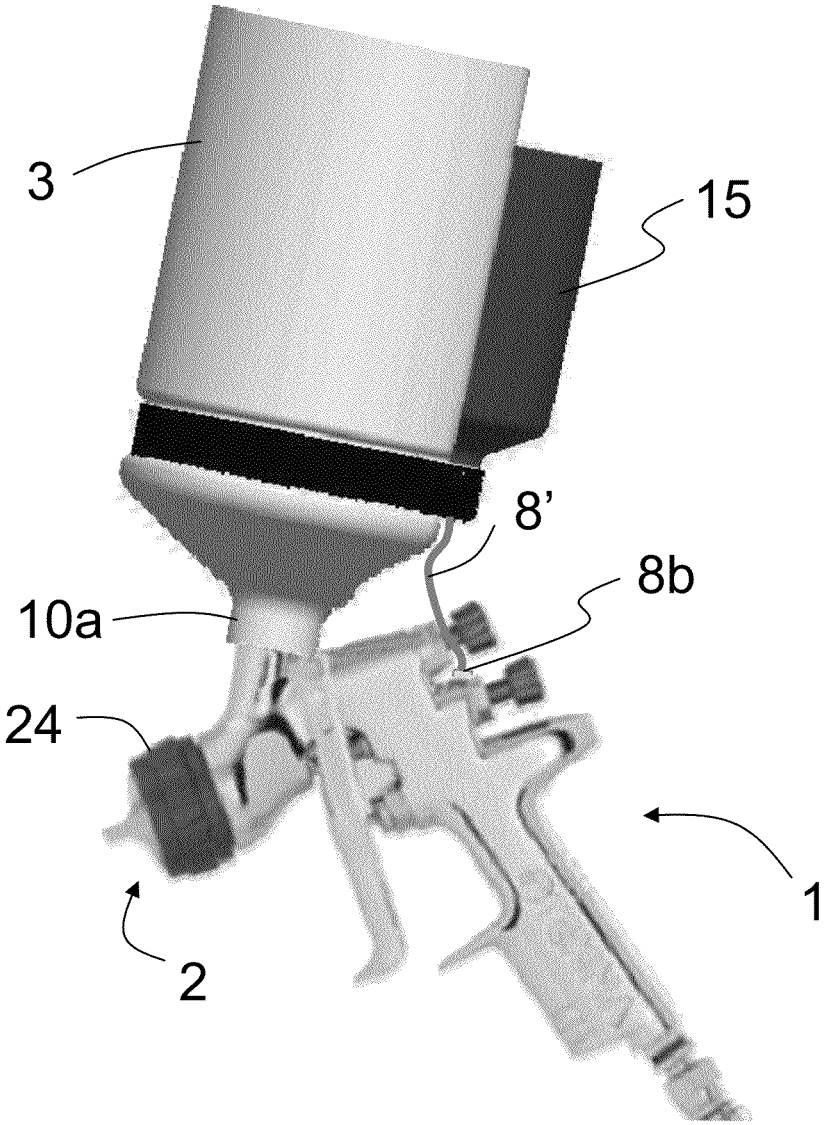
Figure 3D:
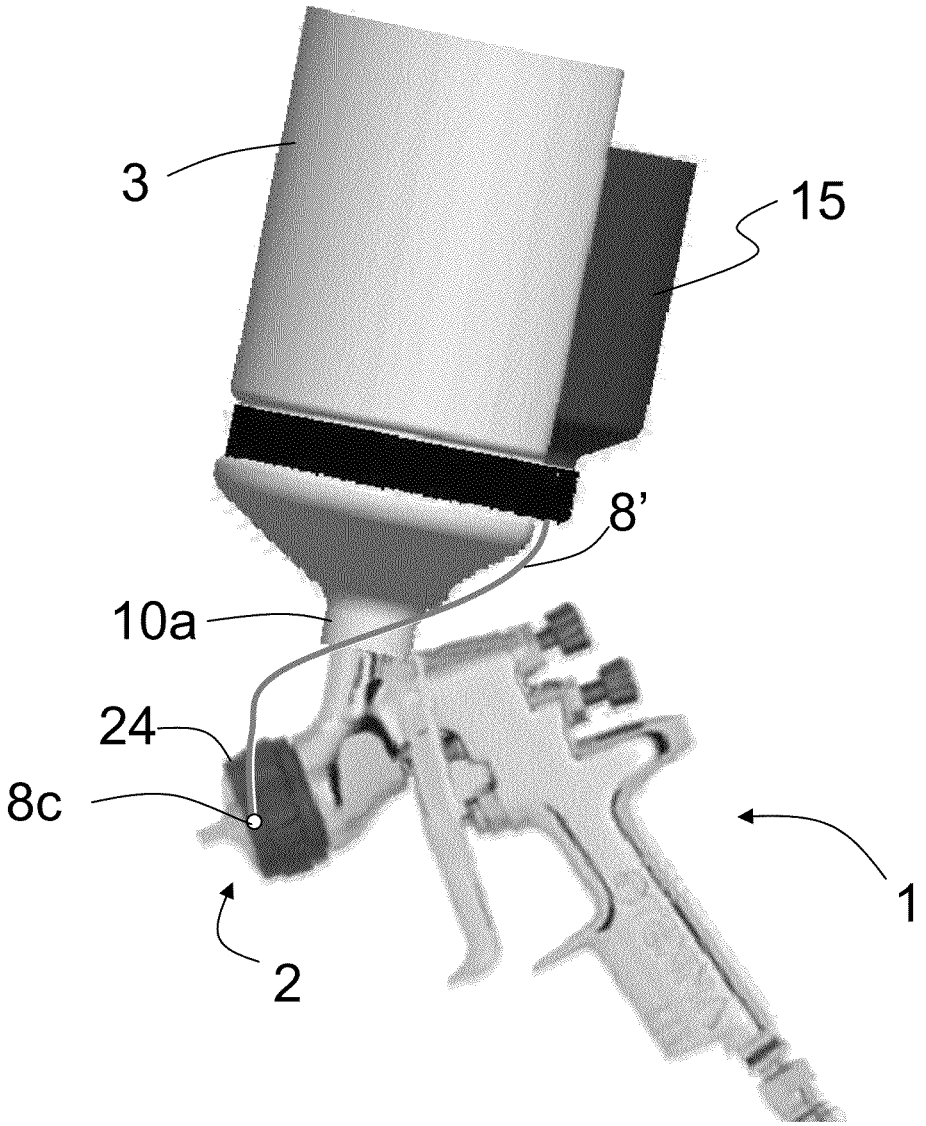
Figure 4A:
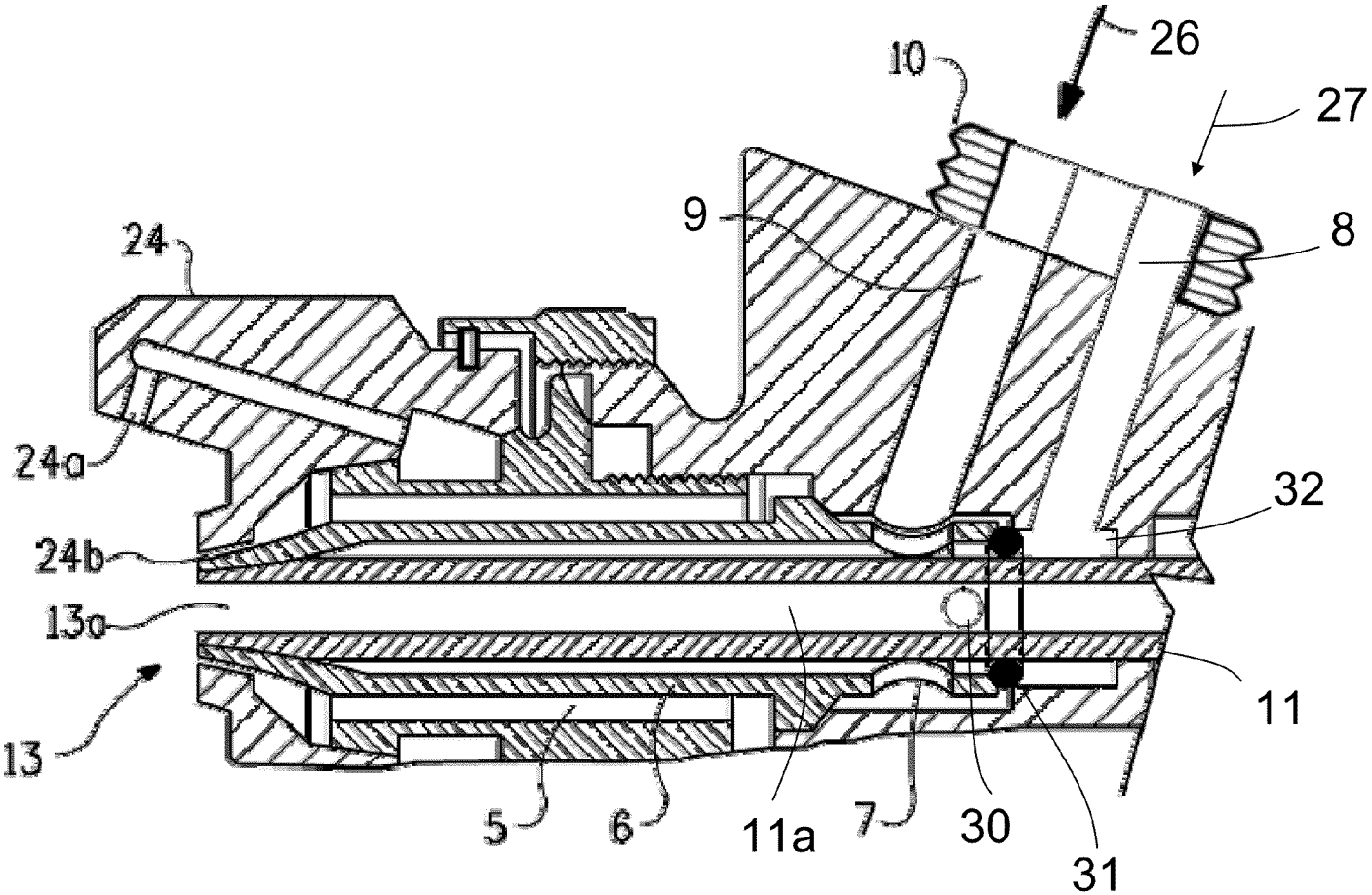
FIG. 4 shows schematic cross-sectional presentations of an example of a spray gun having a hollow needle. (A) The hollow spray needle at the stopped position. (B) The hollow spray needle at the spray position.
Figure 4B:
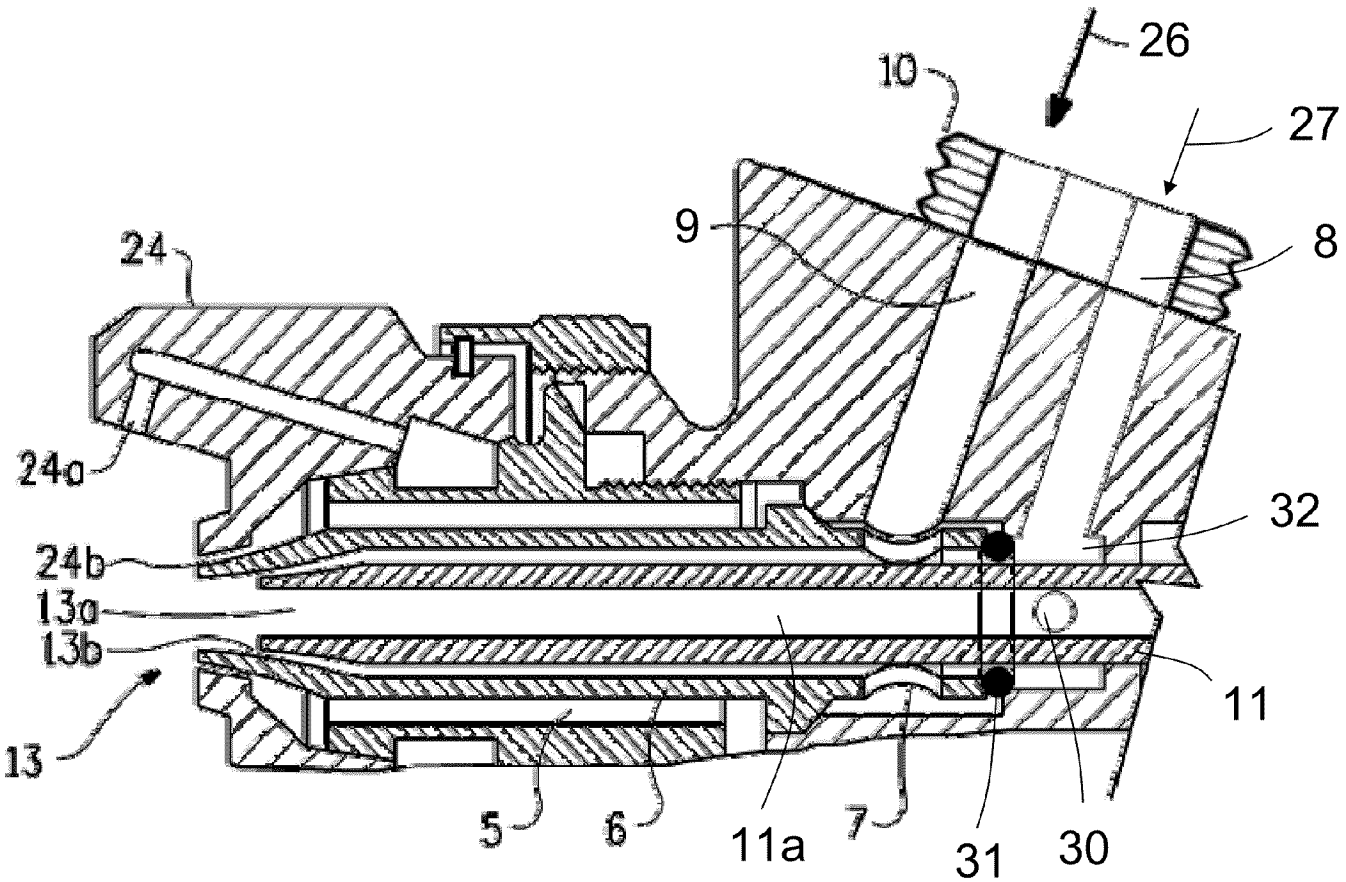
Figure 5A:
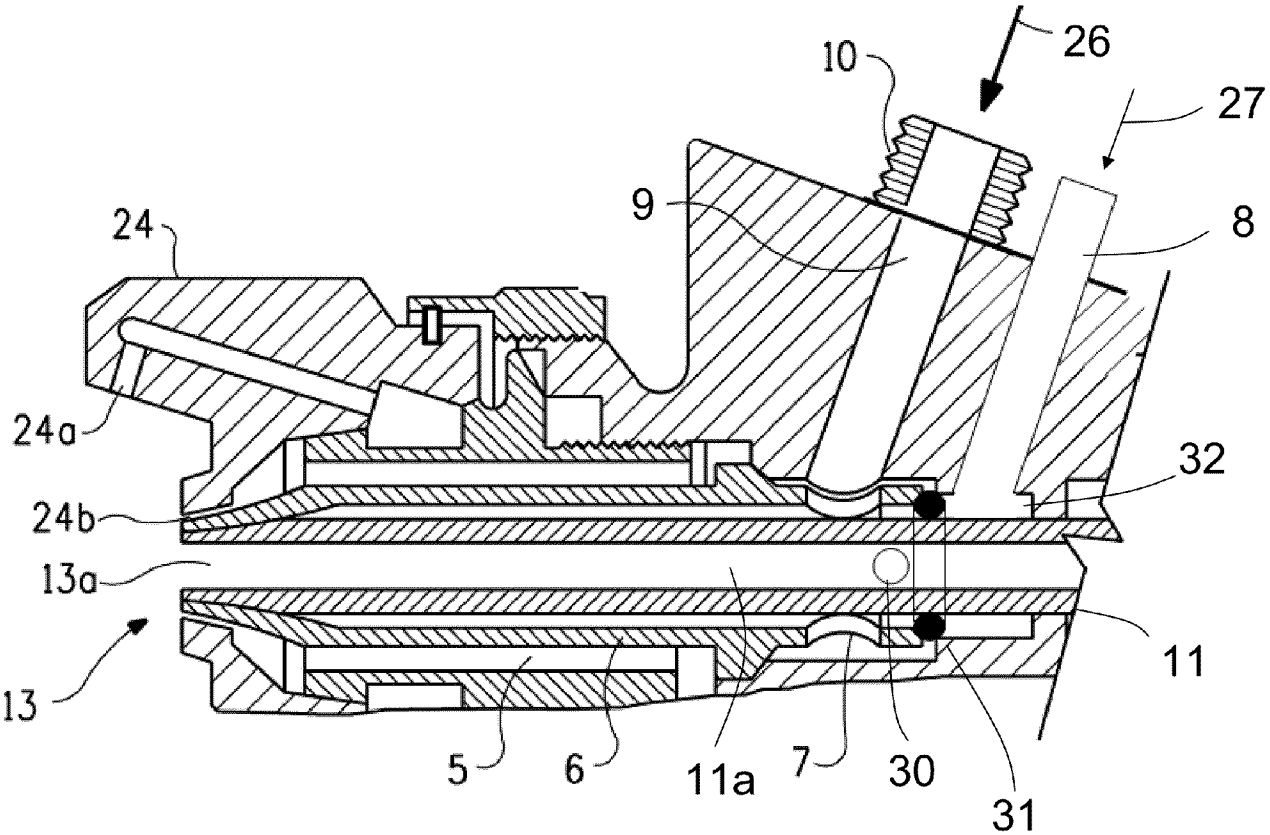
FIG. 5 shows further schematic cross-sectional presentations of an example of a spray gun having a hollow needle. (A) The hollow spray needle at the stopped position. (B) The hollow spray needle at the spray position.
Figure 5B:
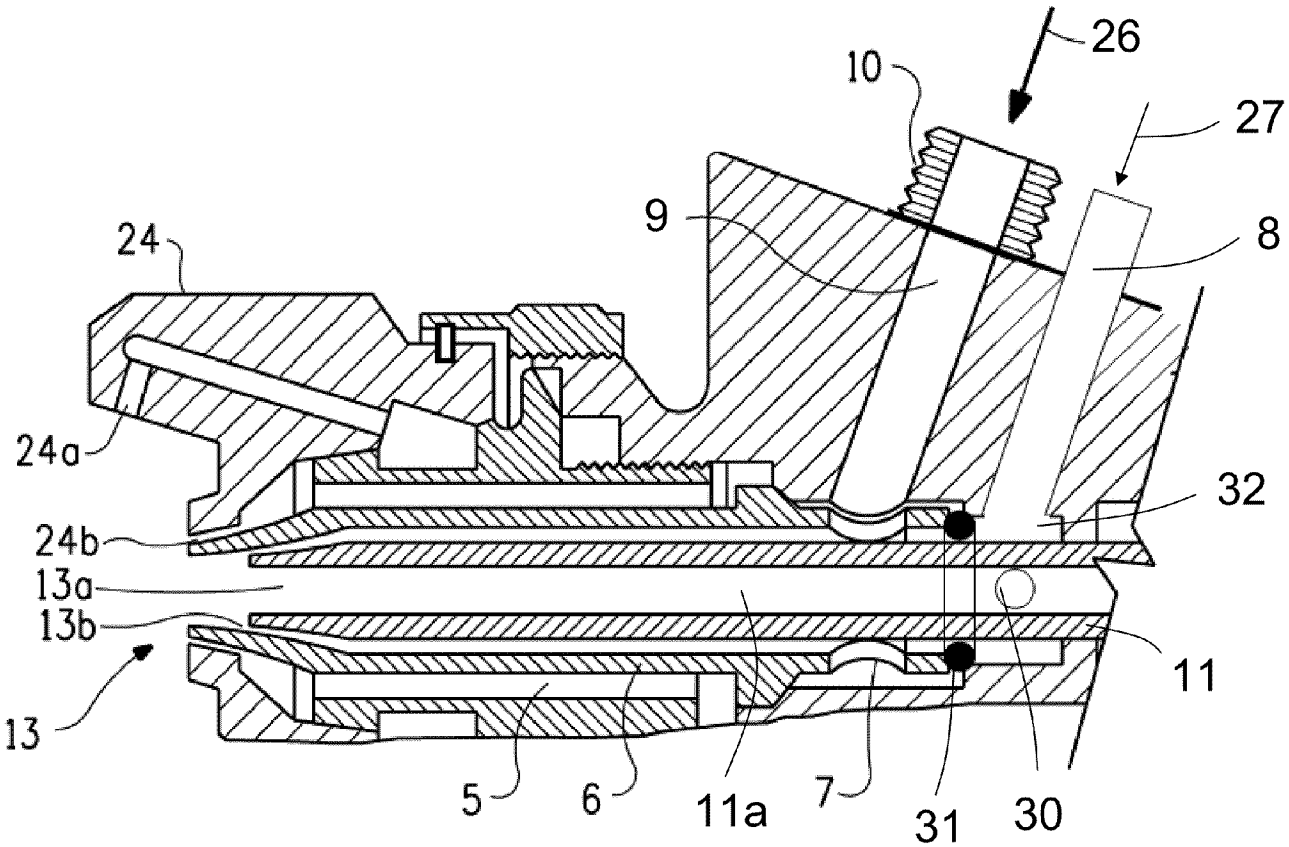
Figure 6A:
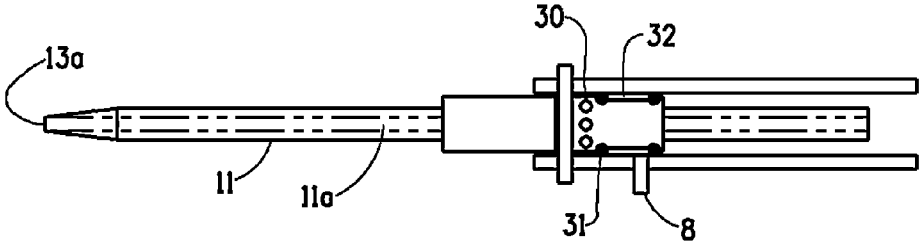
FIG. 6 shows schematic cross-sectional presentations of examples of a hollow needle. (A) The hollow spray needle at the stopped position. (B) The hollow spray needle at the spray position.
Figure 6B:
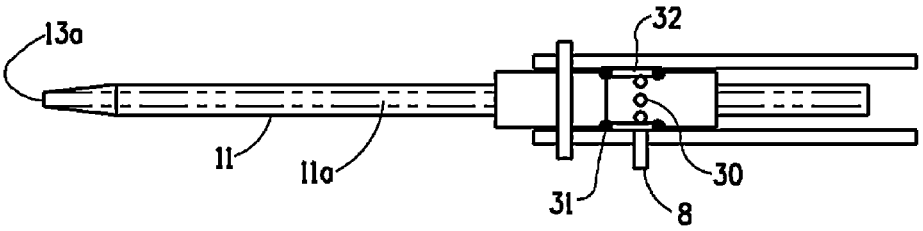
Figure 7A:
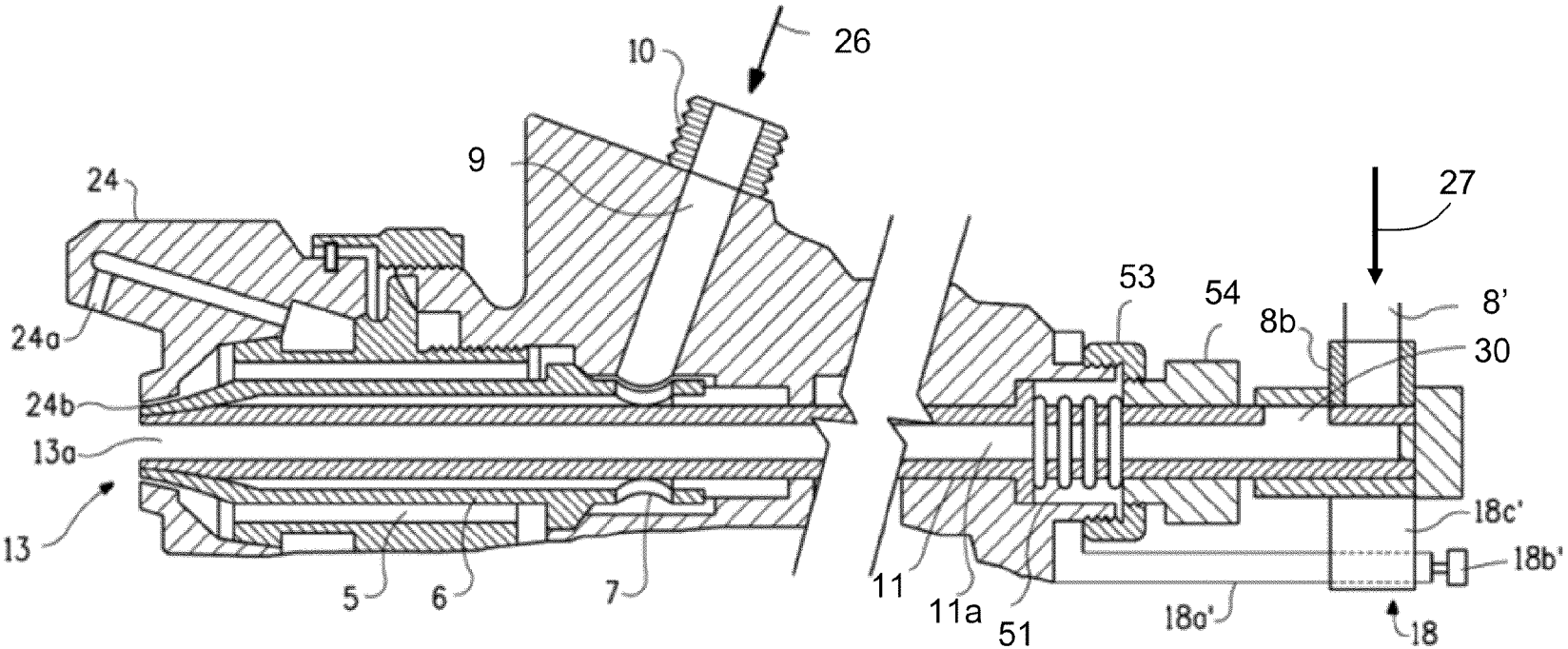
FIG. 7 shows even further schematic cross-sectional presentations of an example of a spray gun having a hollow needle. (A) The hollow spray needle at the stopped position. (B) The hollow spray needle at the spray position.
Figure 7B:
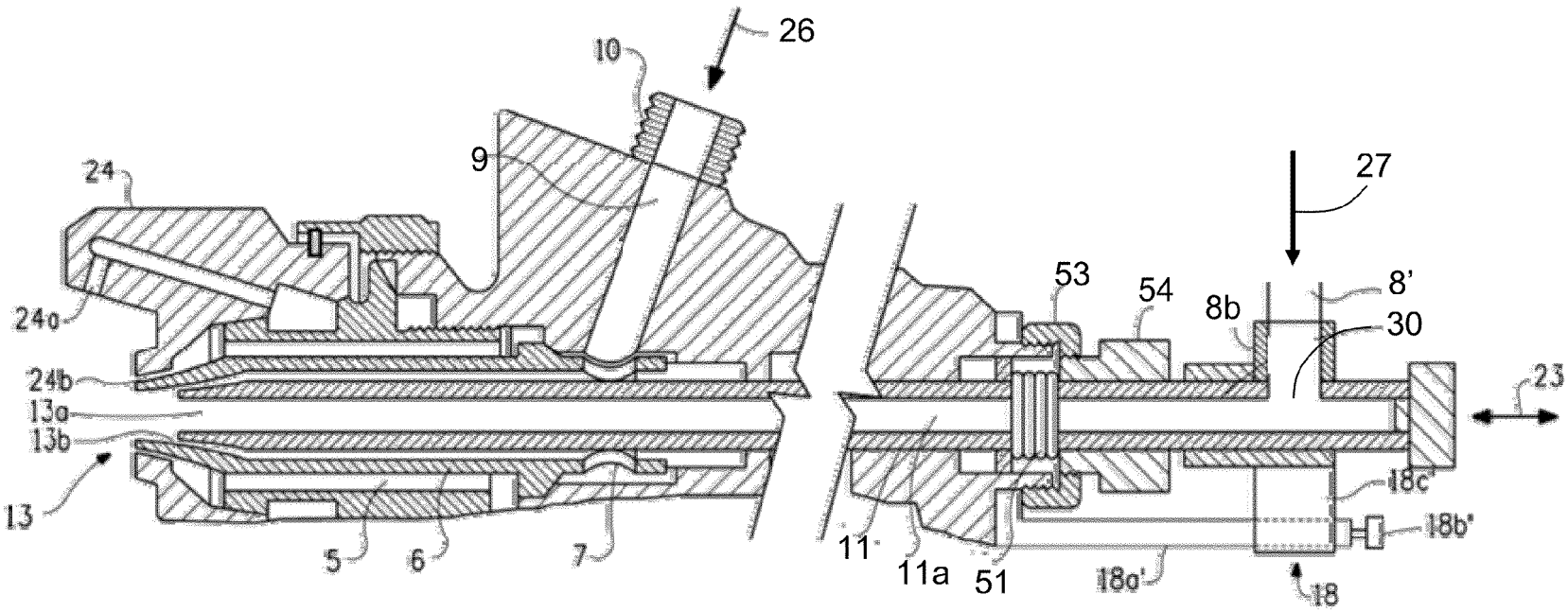
Figure 8A:
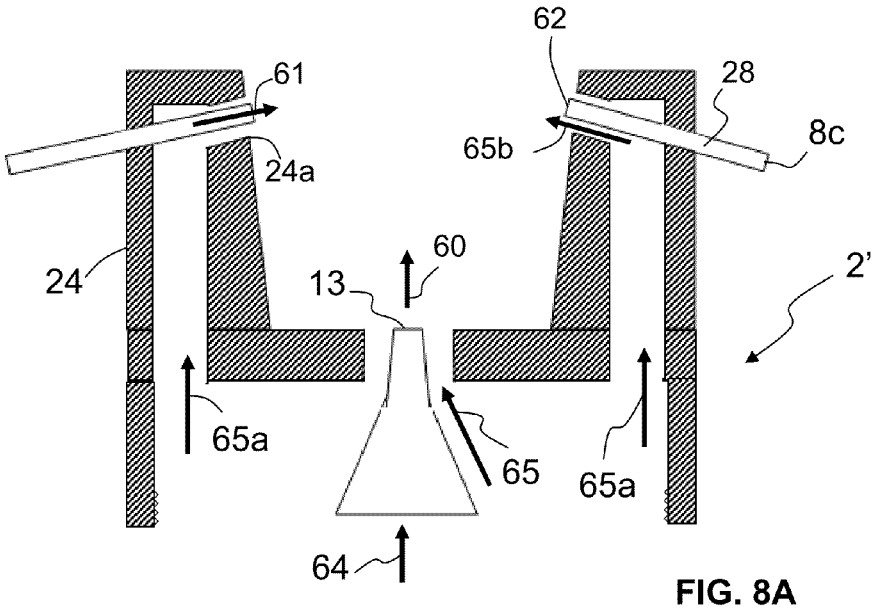
FIG. 8 shows side cross-sectional views of examples of an air cap delivery assembly. (A) One configuration of delivery outlet through shaping air outlet of an air cap. (B) Another configuration of delivery outlet through shaping air outlet of an air cap.
Figure 8B:
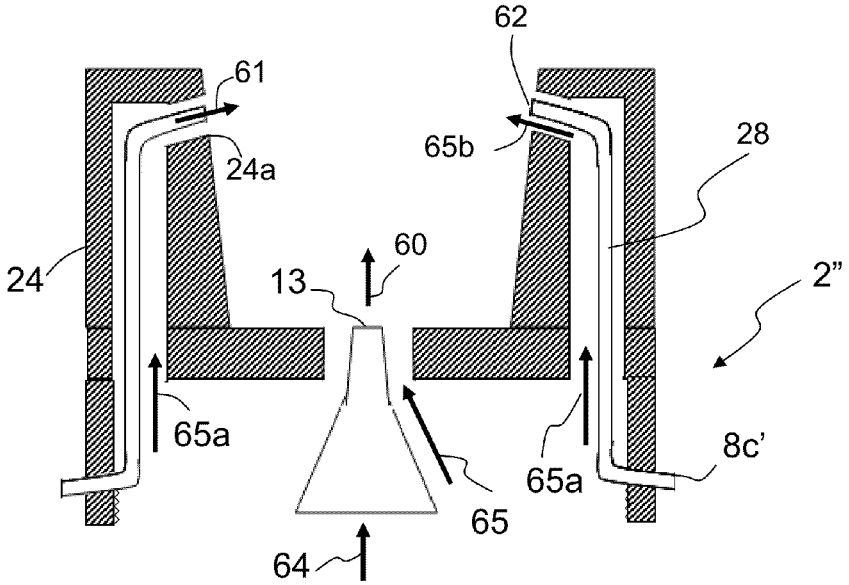

The features and advantages of the present invention will be more readily understood, by those of ordinary skill in the art, from reading the following detailed description. It is to be appreciated that certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both proceeded by the word "about." In this manner, slight variations above and below the stated ranges can be used to achieve substantially the same results as values within the ranges. Also, the disclosure of these ranges is intended as a continuous range including every value between the minimum and maximum values.

As used herein:

"Two-pack coating composition", also known as 2K coating composition, means a thermoset coating composition comprising two components that are stored in separate containers, which are typically sealed for increasing the shelf life of the components of the coating composition. The components are mixed just prior to use to form a pot mix, which has a limited pot life, typically from few minutes, such as 15 minutes to 45 minutes, to few hours, such as 4 hours to 10 hours. The pot mix is applied as a layer of desired thickness on a substrate surface, such as the body or body parts of a vehicle. After application, the layer dries and cures to form a coating on the substrate surface having desired coating properties, such as, desired gloss, mar-resistance, resistance to environmental etching and resistance to degradation by solvent. A typical two-pack coating composition can comprise a crosslinkable component and a crosslinking component.

"One-Pack coating composition", also known as 1K coating composition, means a coating composition comprises multiple ingredients mixed in one single package. A one-pack coating composition can form a coating layer under certain conditions. One example of 1K coating composition can comprise a blocked crosslinking agent that can be activated under certain conditions. One example of the blocked crosslinking agent can be a blocked isocyanate. Another example of 1K coating composition can be a ultraviolet (UV) radiation curable coating composition.

The term "radiation", "irradiation" or "actinic radiation" means radiation that causes, in the presence of a photo initiator, polymerization of monomers that have polymerizable ethylenically unsaturated double bonds, such as acrylic or methacrylic double bonds. Sources of actinic radiation may be natural sunlight or artificial radiation sources. Other examples of radiation can include electron-beam, also known as e-beam. A coating curable by radiation, such as UV, can be referred to as a radiation coating or a UV coating. A UV coating can be typically a 1K coating. A UV curable coating can typically have a UV curable component comprising monomers that have polymerizable ethylenically unsaturated double bonds, such as acrylic or methacrylic double bonds; and one or more photo initiators or radiation activators. Typically, a 1K coating composition, for example a UV mono-cure coating composition, can be prepared to form a pot mix and stored in a sealed container. As long as said UV mono-cure coating composition is not exposed to UV radiation, said UV mono-cure coating composition can have indefinite pot life.

A coating that can be cured by one curing mechanism, such as by chemical crosslinking alone or by UV radiation alone, can be referred to as a mono-cure coating. A coating that can be cured by both chemical and radiation, such as by both chemical crosslinking and UV radiation, can be referred to as a dual-cure coating.

"Low VOC coating composition" means a coating composition that includes less than 0.6 kilograms per liter (5 pounds per gallon), preferably less than 0.53 kilograms (4.4 pounds per gallon) of volatile organic component, such as certain organic solvents. The phrase "volatile organic component" is herein referred to as VOC. VOC level is determined under the procedure provided in ASTM D3960.

"Crosslinkable component" includes a compound, oligomer, polymer or copolymer having functional crosslinkable groups positioned in each molecule of the compound, oligomer, the backbone of the polymer, pendant from the backbone of the polymer, terminally positioned on the backbone of the polymer, or a combination thereof. One of ordinary skill in the art would recognize that certain crosslinkable group combinations would be excluded from the crosslinkable component of the present invention, since, if present, these combinations would crosslink among themselves (self-crosslink), thereby destroying their ability to crosslink with the crosslinking groups in the crosslinking components defined below.

Typical crosslinkable component can have on an average 2 to 25, preferably 2 to 15, more preferably 2 to 5, even more preferably 2 to 3, crosslinkable groups selected from hydroxyl, acetoacetoxy, carboxyl, primary amine, secondary amine, epoxy, anhydride, imino, ketimine, aldimine, or a combination thereof.

The crosslinkable component can have protected crosslinkable groups. The "protected" crosslinkable groups are not immediately available for curing with crosslinking groups, but first must undergo a reaction to produce the crosslinkable groups. Examples of suitable protected crosslinkable components having protected crosslinkable groups can include, for example, amide acetal, orthocarbonate, orthoacetate, orthoformate, spiroorthoester, orthosilicate, oxazolidine or combinations thereof.

The protected crosslinkable groups generally are not crosslinkable without an additional chemical transformation. The chemical transformation for these groups can be a deprotection reaction such as hydrolysis reaction that unprotects the group to form a crosslinkable group that can then be reacted with the crosslinking component to produce a crosslinked network. Each one of these protected groups, upon the deprotection reaction, forms at least one crosslinkable group. For example, upon hydrolysis, an amide acetal can form an amide diol or one of two amino alcohols. As another example, the hydrolysis of an orthoacetate can form a hydroxyl group.

The crosslinkable component can contain compounds, oligomers and/or polymers that have crosslinkable functional groups that do not need to undergo a chemical reaction to produce the crosslinkable group. Such crosslinkable groups are known in the art and can include, for example, hydroxyl, acetoacetoxy, thiol, carboxyl, primary amine, secondary amine, epoxy, anhydride, imino, ketimine, aldimine, silane, aspartate or a suitable combination thereof.

Suitable activators for deprotecting the protected crosslinkable component can include, for example, water, water and acid, organic acids or a combination thereof. In one embodiment, water or a combination of water and acid can be used as an activator to deprotect the crosslinkable component. For example, water or water with acid can be an activator for a coating described in PCT publication WO2005/092934, published on Oct. 6, 2005, wherein water activates hydroxyl groups by hydrolyzing orthoformate groups that block the hydroxyl groups from reacting with crosslinking functional groups.

"Crosslinking component" is a component that includes a compound, oligomer, polymer or copolymer having crosslinking functional groups positioned in each molecule of the compound, oligomer, the backbone of the polymer, pendant from the backbone of the polymer, terminally positioned on the backbone of the polymer, or a combination thereof, wherein these functional groups are capable of crosslinking with the crosslinkable functional groups on the crosslinkable component (during the curing step) to produce a coating in the form of crosslinked structures or networks. One of ordinary skill in the art would recognize that certain crosslinking group/crosslinkable group combinations would be excluded from the present invention, since they would fail to crosslink and produce the film forming crosslinked structures or networks.

Typical crosslinking component can be selected from a compound, oligomer, polymer or copolymer having crosslinking functional groups selected from the group consisting of isocyanate, amine, ketimine, melamine, epoxy, polyacid, anhydride, and a combination thereof. It would be clear to one of ordinary skill in the art that generally certain crosslinking groups from crosslinking components crosslink with certain crosslinkable groups from the crosslinkable components.

A coating composition can further comprise a catalyst, an initiator, an activator, a curing agent, or a combination thereof. A coating composition can also comprise a radiation activator if the coating composition is a radiation curable coating composition, such as a UV curable coating composition.

A catalyst can initiate or promote the reaction between reactants, such as crosslinkable functional groups of a crosslinkable component and crosslinking functional groups of a crosslinking component of a coating composition. A wide variety of catalysts can be used, such as, tin compounds, including organotin compounds such as dibutyl tin dilaurate; or tertiary amines, such as, triethylenediamine. These catalysts can be used alone or in conjunction with carboxylic acids, such as, acetic acid. One example of commercially available catalysts is dibutyl tin dilaurate as Fascat® series sold by Arkema, Bristol, Pa., under respective trademark.

An activator can activate one or more components of a coating composition. For example, water can be an activator for a coating described in PCT publication WO2005/092934, published on Oct. 6, 2005, wherein water activates hydroxyl groups by hydrolyzing orthoformate groups that block the hydroxyl groups from reacting with crosslinking functional groups.

An initiator can initiate one or more reactions. Examples can include photo initiators and/or sensitizers that cause photopolymerization or curing of a radiation curable coating composition, such as a UV curable coating composition upon radiation, such as UV irradiation. Many photo initiators are known to those skilled in the art and can be suitable for this invention.

A radiation activator can be activated by radiation and then initiate or catalyze subsequent one or more reactions. One example can be photolatent catalyst available from Ciba Specialty Chemicals.

A curing agent can react with other components of a coating composition to cure the coating composition into a coating. For example, a crosslinking component, such as isocyanate, can be a curing agent for a coating comprising a crosslinkable hydroxyl component. On the other hand, a crosslinkable component can be a curing agent for a crosslinking component.

In conventional coating practice, components of a two-pack coating composition are mixed immediately prior to spraying to form a pot mix which has a limited pot life, wherein said components can include a crosslinking component, a crosslinkable component, necessary catalysts, and other components necessary as determined by those skilled in the art. In addition to the limited pot life, many catalysts can change its activity in the pot mix. For example, some catalysts can be sensitive to the trace amount of water in the pot mix since water can cause hydrolysis and hence inactivation of the catalyst.

This disclosure is directed to a spray gun for spraying a coating composition having a first component and a second component. The spray gun can comprise:

(A) a spray gun body (1) comprising a carrier inlet (12), a first inlet (10) connected to a first delivery path (9) within said spray gun body connected to a spray nozzle (13), a second inlet (8) connectable to a second delivery path, a spray trigger (22), and a spray nozzle assembly (2) comprising said spray nozzle and an air cap (24), wherein said spray trigger has a stop position, a pre-spray position and a spray position;

(B) a dual feeding cup assembly comprising a first cup (3), a second cup (15), and a cup connection coupling (10*a*) affixing said first cup and said second cup together side-by-side, wherein said cup connection coupling is connectable to said spray gun body;

wherein:

said first component and said second component are maintained separated in said spray gun and said dual feeding cup assembly;

said first inlet is configured to receive said first component by gravity and connected to said first delivery path to convey said first component to said spray nozzle assembly when said spray trigger is at said spray position; and said second inlet is configured to receive said second component by gravity and to convey said second component to said spray nozzle assembly when said spray trigger is at said spray position.

The spray can further comprise:

(C) a hollow spray needle (11) having a longitudinal channel (11*a*) therein, a channel opening (13*a*) at one end of said hollow spray needle, and a needle inlet (30) at the other end of said hollow spray needle distal to said channel opening (13*a*);

wherein said second delivery path comprises said longitudinal channel; and wherein said needle inlet is connected to said second inlet when said trigger is at said spray position, and said needle inlet is disconnected to said second inlet when said spray trigger is at said stop position.

The spray gun can also further comprising:

(D) an air cap delivery device comprising a delivery outlet (62) connected to said second inlet (8) through said second delivery path, said delivery outlet being positioned within said air cap.

The delivery outlet can be a tube inserted in one of shaping air outlets of said air cap.

The second inlet can be affixed to said air cap.

The second cup and said second inlet can be connected with a flexible tubular connector, a fixed shape tubular connector, or a combination thereof.

This disclosure is also directed to a kit for converting a spray gun to spray a coating composition having a first component and a second component. The kit can comprise:

(a) a dual feeding cup assembly comprising a first cup (3), a second cup (15), and a cup connection coupling (10*a*) affixing said first cup and said second cup together side-by-side, wherein said cup connection coupling is connectable to said spray gun body; and a delivery device selected from:

(b) a hollow spray needle (11) having a longitudinal channel (11*a*) therein, a channel opening (13*a*) at one end of said hollow spray needle, and a needle inlet (30) at the other end of said hollow spray needle distal to said channel opening (13*a*), and a detachable coupling assembly (18) connectable to said second cup, said hollow spray needle and said spray gun;

(c) an air cap delivery device comprising a delivery outlet (62) connected to a second inlet (8) through a second delivery path, said delivery outlet being positioned within an air cap, said air cap is connectable to said spray gun, and said second inlet is connectable to said second cup; or (d) a combination of (b) and (c).

The kit of claim 7, wherein said detachable coupling assembly (18) can be assembled externally to said spray gun body.

The detachable coupling assembly (18) can comprise a frame, a second connection coupling, a valve coupling, and one or more fasteners.

The valve coupling can be selected from a wedge valve coupling, a sliding valve coupling, or a combination thereof.

This disclosure is further directed to a two-component spray gun comprising the aforementioned kit, for example a conventional one component spray gun converted by using the kit.

This disclosure is even further directed to a method for producing a coating layer over a substrate from a coating composition comprising a first component and a second component, said method comprising the steps of:

i) providing an aforementioned two-component spray gun;

ii) spraying said first component and said second component using said two-component spray gun over said substrate to form a wet coating layer thereon; and iii) curing said wet coating layer to form said coating layer.

The method can further comprise the step of curing said layer of said coating composition. The coating composition can be cured at ambient temperatures, such as in a range of from 15° C. to 35° C., or at elevated temperatures, such as in a range of from 35° C. to 400° C.

The pressurized carrier can be selected from compressed air, compressed gas, compressed gas mixture, or a combination thereof. The substrate can be a vehicle, vehicle body, or vehicle body parts.

The coating composition can be selected from a lacquer coating composition, a chemical curable coating composition, a radiation curable coating composition, or a chemical and radiation dual-cure coating composition. In one example, the first component can comprise a crosslinkable and a crosslinking component and said second component comprises a catalyst or a latent catalyst. In another example, the first component can also comprise a radiation curable component and the second component can comprise a photo initiator. In yet another example, the first component can comprise a crosslinkable component, a crosslinking component and a radiation curable component, and said second component can comprise a catalyst, an initiator, a radiation activator, or a combination thereof. In yet another example, the first component can comprise a crosslinkable component and said second component can comprise a crosslinking component. In yet another example, the first component can comprise a radiation curable component and a crosslinkable component, and the second component can comprise a crosslinking component. In yet another example, the first component can comprise protected crosslinkable groups and a crosslinking component, and the second component can comprise water and optionally an acid. In yet another example, the first component can comprise protected crosslinkable groups, and the second component comprises a crosslinking component, water, and optionally an acid. In yet another example, the second component can be selected from a catalyst, an initiator, an activator, a radiation activator, a curing agent, or a combination thereof. In yet another example, the coating mixture can have a coating viscosity that is increasing upon time and the first component and the second component can be at essentially constant individual viscosity upon time.

Another advantage of this invention can include the ability for controlling viscosity of a coating composition. The coating mixture can have a coating viscosity that is increasing upon time, while the first component and the second component can be at essentially constant individual viscosity. That means that the first component and the second component can be at an individual viscosity essentially constant at the beginning and the end of spray operation. This can be particularly useful for spraying coating compositions that viscosity increases very rapidly if all components are mixed together. By utilizing this invention, individual components of such coating compositions can be mixed after atomization. The viscosity of individual component can be essentially constant during spray operation.

The substrate can be wood, plastic, leather, paper, woven and nonwoven fabrics, metal, plaster, cementitious and asphaltic substrates, and substrates that have one or more existing layers of coating thereon. The substrate can be vehicle body or vehicle parts thereof.

Although coating compositions with multiple coating components are specifically described here, this invention can also be used for a composition having multiple components that need to be mixed to form a mixed composition. With this invention, a first component of the composition can be atomized by a spray device and a second or a subsequent component of the composition can be siphoned into the atomized first component to form the mixed composition.

What is claimed is:

1. A spray gun for spraying a coating composition having a first component and a second component, said spray gun comprising:

(A) a spray gun body comprising a carrier inlet, a first inlet connected to a first delivery path within said spray gun body connected to a spray nozzle, a second inlet connectable to a second delivery path, a spray trigger, and a spray nozzle assembly comprising said spray nozzle and an air cap, wherein said spray trigger has a stop position, a prespray position and a spray position;

(B) a dual feeding cup assembly comprising a first cup, a second cup, and a cup connection coupling affixing said first cup and said second cup together side-by-side, wherein said cup connection coupling is connectable to said spray gun body;

(C) a hollow spray needle having a longitudinal channel therein, a channel opening at one end of said hollow spray needle, and a needle inlet at the other end of said hollow spray needle distal to said channel opening;

wherein said second delivery path comprises said longitudinal channel; and wherein:

said first component and said second component are maintained separated in said spray gun and said dual feeding cup assembly;

said first inlet is configured to receive said first component by gravity and connected to said first delivery path to convey said first component to said spray nozzle assembly when said spray trigger is at said spray position;

said second inlet is configured to receive said second component by gravity and to convey said second component to said spray nozzle assembly when said spray trigger is at said spray position; and said needle inlet is connected to said second inlet when said trigger is at said spray position, and said needle inlet is disconnected to said second inlet when said spray trigger is at said stop position.

2. The spray gun of claim 1 further comprising:

(D) an air cap delivery device comprising a delivery outlet connected to said second inlet through said second delivery path, said delivery outlet being positioned within said air cap.

3. The spray gun of claim 2, wherein said delivery outlet is a tube inserted in one of shaping air outlets of said air cap.

4. The spray gun of claim 2, wherein said second inlet is affixed to said air cap.

5. The spray gun of claim 1, wherein said second cup and said second inlet are connected with a flexible tubular connector, a fixed shape tubular connector, or a combination thereof.

6. A method for producing a coating layer over a substrate from a coating composition comprising a first component and a second component, said method comprising the steps of:

i) providing a two-component spray gun of claim 1;

ii) spraying said first component and said second component using said two-component spray gun over said substrate to form a wet coating layer thereon; and iii) curing said wet coating layer to form said coating layer.

7. The method of claim 6, wherein said substrate is a vehicle, vehicle body parts, or a combination thereof.

8. The method of claim 6, wherein said wet coating layer is cured at a temperature in a range of from 15° C. to 35° C.

9. The method of claim 6, wherein said wet coating layer is cured at a temperature in a range of from 35° C. to 400° C.

* * * * *